US007377079B2

(12) United States Patent
Burow

(10) Patent No.: US 7,377,079 B2
(45) Date of Patent: May 27, 2008

(54) FLEXIBLY CONNECTED PANEL ELEMENTS

(75) Inventor: Hans-Jürgen Burow, Oerlinghausen (DE)

(73) Assignee: W. Lehbrink GmbH & Co. KG, Maschinenfabrik, Oerlinghausen (DE)

( * ) Notice: Subject to any disclaimer, the term of this patent is extended or adjusted under 35 U.S.C. 154(b) by 623 days.

(21) Appl. No.: 10/640,027

(22) Filed: Aug. 14, 2003

(65) Prior Publication Data

US 2004/0045246 A1 Mar. 11, 2004

(30) Foreign Application Priority Data

Aug. 14, 2002 (EP) ..... 02018337

(51) Int. Cl.
*E04B 1/00* (2006.01)

(52) U.S. Cl. ..... 52/64; 52/65; 52/71; 52/591.5; 52/589.1; 52/590.3; 52/592.4

(58) Field of Classification Search ..... 52/64–72, 52/589.1–592.2
See application file for complete search history.

(56) References Cited

U.S. PATENT DOCUMENTS 2,829,745 A * 4/1958 Heitler ..... 190/28
3,546,038 A * 12/1970 Randall et al. ..... 156/83
3,562,973 A * 2/1971 Gangemi ..... 51/71
3,913,656 A * 10/1975 Guyer ..... 160/135
5,107,639 A * 4/1992 Morin et al. ..... 52/71
5,513,472 A * 5/1996 Olsen et al. ..... 52/177
6,182,903 B1 * 2/2001 Fiedrich ..... 237/69
6,270,016 B1 * 8/2001 Fiedrich ..... 237/69

FOREIGN PATENT DOCUMENTS

DE 198 04 787 8/1999
FR 2465658 A * 4/1981

* cited by examiner

*Primary Examiner*—Jeanette Chapman
(74) *Attorney, Agent, or Firm*—Buchanan Ingersoll & Rooney PC

(57) ABSTRACT

The invention relates to two panel elements which are flexibly connected to one another, at least one profiled lateral edge being provided on each of the panel elements for the flexible connection which, as connecting edges, have a suitable bearing and contact surface for an adhesive strip connecting the panel elements, so that the swivel axis is in the area of the adhesive strip. To prevent a transparent effect in the joint area, the connecting edges have a further profiling which enters a form-locking connection when the connecting edges are turned on one another. Furthermore, the invention comprises the method and the facility for producing the flexibly connected panel elements.

3 Claims, 3 Drawing Sheets

FLEXIBLY CONNECTED PANEL ELEMENTS

This application claims priority under 35 U.S.C. §§119 and/or 365 to Patent Application Serial No. 02 018 337.2 filed in Europe on Aug. 14, 2002.

BACKGROUND OF THE INVENTION

The invention relates to panel elements which are flexibly connected to one another. At least one profiled lateral edge is provided on each of the panel elements for the flexible connection. The connecting edges have a suitable bearing and contact surfaces for an adhesive strip which connects the panel elements, so that the swivel axis is in the area of the adhesive strip.

Panel elements, preferably fibreboards, are known from the prior art which, for example, are used as the back wall of cabinets. They are connected to one another by means of separate connecting elements and fixed to the back side of a cabinet. To minimize handling of individual parts, knock-down back walls for cabinets are known which can be assembled without additional accessories. For this purpose, a method for producing foldable fibreboards is proposed according to DE 198 04 787. The fibreboards have at least one visible side, the fibreboard parts being connected to one another by an adhesive or an adhesive strip, at least by section along a connecting edge. Due to this construction, both panel elements form a unit which is foldable. To this end, the panel elements have at least one profiled lateral edge which, as connecting edges, are profiled so that a suitable bearing and contact surface is produced to which the connecting adhesive strip is applied. A swivel axis about which the two panel elements can be folded or turned is produced in the area of the adhesive strip.

In this case, it is considered disadvantageous that the adhesive strip connecting the panel elements remains visible. In particular in the joint area to the visible surface of the connecting panel elements, due to the fact that the swivel axis which is formed by the adhesive strips comes to lie on the visible side of the panel elements. A further disadvantage of this embodiment is that the adhesive strip connecting the panel elements has a transparent effect, so that light action through the adhesive strip is noticeable on the visible side of the panel elements.

Thus, the object of the invention is to further develop flexibly connected panel elements in which the adhesive strips connecting the panel elements are not visible on the visible side and further, a transparent effect is completely prevented in the joint area.

SUMMARY OF THE INVENTION

According to the invention, this object is solved in that the connecting edges have a further profiling which results in a form-locking connection when the connecting edges are turned on one another. The result of this design is that, due to an additional profiling which produces a form-locking connection between the connecting edges, the flexible connection is covered when the panel segments are turned. Thus, the form-locking connection is on the flexible connection which results in the adhesive strip being completely covered from the visible side. The profiling of the one connecting edge is thereby conical and the profiling of the other connecting edge is groove-shaped. In this way, a back light effect does not shine through on the visible side of the panel elements due to the interlocking connection created. In this case, the conical connecting edge is preferably V-shaped and the groove-shaped connecting edge is designed accordingly so as to correspond thereto. This results in a male and a female connecting edge area, as a result of which a reinforcement of the edge area is obtained due to its form-locking connection. It is especially advantageous that the additional profiling enables a two-sided coating of the panel elements, as no open joint seams are produced in the surface of the turned panel elements.

The profiled area accommodating the adhesive strip is designed such that the bearing and contact surface of the connecting edges extend at a slant which, when the panel elements are turned, form a triangular space between the connecting edges which is limited by the form-locking connection. In this way, a cavity is produced between the edges of the panel elements. The adhesive strip comes to lie with its sides within the cavity: the swivel position being between the connecting edges. As already described, the profiled form-locking connection covers the profiled swivel area, so that a clean and non-transparent joint is produced between the two panel elements toward the light side of the panel elements. To this end, the adhesive strip connecting the panel elements is applied advantageously to the inclined planes.

Furthermore, a method for producing the panel elements is proposed which, according to the invention, is characterized in that, for processing the form-locking connecting edges, the thickness of the superimposed panel elements is first measured in a first procedural step in order to in this way mathematically ascertain a determination of the zero-point position which corresponds to the fold edge and wherein, in a second procedural step, the units required to process the connecting edges are adjusted to the calculated zero position by means of a digital computer control. It is thus ensured according to the method of the invention that, in particular, the profiled lateral edges of the individual panel elements undergoes an adjustment of the units to be processed. In this way, a lateral edge profiling can take place which ensures the form-locking connection of the folded panel elements. Therefore, if the panel elements have passed through the measuring apparatus, then the subsequent units are aligned accordingly on adjustable axes, so that they undertake an exact engagement at the individual lateral edge of the superimposed panel elements. As a result, a system is created which automatically adjusts itself to various thicknesses of the panel elements in a varying or correcting manner. This ensures that the profiled lateral edges defining the foldable panel elements can be produced with the same quality.

For this purpose, a facility is provided which comprises a measuring apparatus which measures the thickness resulting in the facility of the superimposed panel elements, so that a numerical zero-point position of the fold edge can be determined, so that the unit to be subsequently added for processing the connecting edge can be adjusted to this calculated zero-point position by means of a digital computer control. The digital control drives the milling tool for profiling the connecting edges, the chamfering device and an adhesive applicator into the exact position.

The measuring apparatus thereby essentially consists of a measuring rocker with a roller which interacts with a support roller between which the superimposed panel elements are guided, a primary element interacting with the measuring rocker to control the subsequent units.

BRIEF DESCRIPTION OF THE DRAWINGS

The objects and advantages of the invention will become apparent from the following detailed description of a preferred embodiment thereof in connection with the accompanying drawing in which like numerals designate like elements.

DESCRIPTION OF PREFERRED EMBODIMENTS OF THE INVENTION

Figure 1:
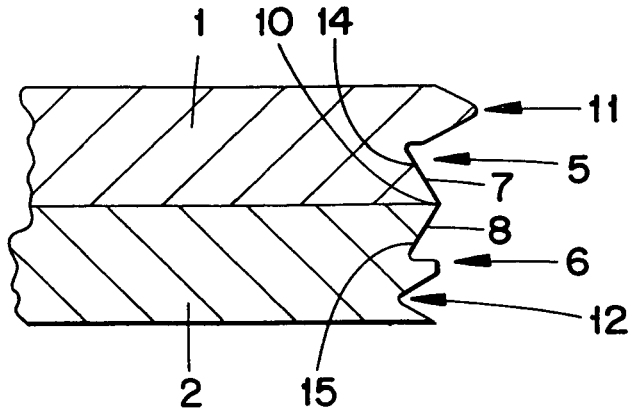
FIG. 1 a partial sectional view of two superimposed panel elements with their profiling symmetry.
Figure 2:
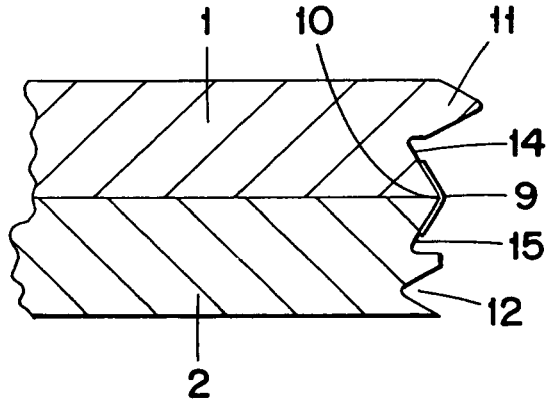
FIG. 2 a view according to FIG. 1 with affixed adhesive strip.
Figure 3:
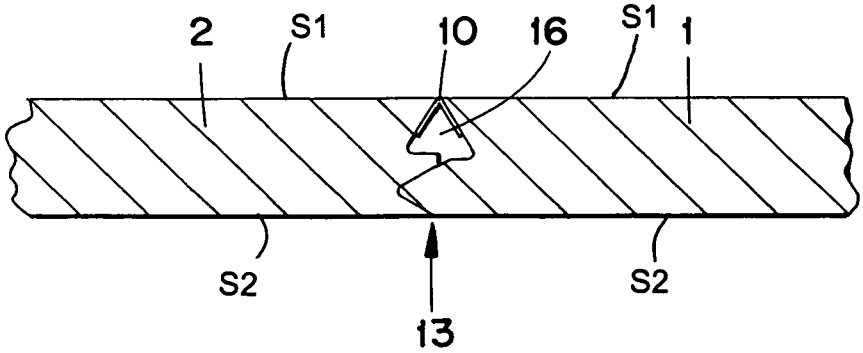
FIG. 3 a representation of the two panel elements in the turned state.

FIG. 1 shows to panel elements 1 and 2 in the side view which, as shown in FIG. 3, are flexibly connected to one another. The panel elements 1 and 2 have at least one profiled lateral edge surface 5, 6 on each of the panel elements 1, 2 for the flexible connection. The lateral edge surface 5, 6 intersects two side surfaces S1, S2 of the panel. The lateral edge surfaces 5, 6 serve as connecting edges having a suitable bearing surface 7, 8 for an adhesive strip 9 joining the panel elements 1, 2, as shown in FIG. 2. As shown in FIG. 3, a swivel axis 10 is produced in this way in the area of the adhesive strip 9.

If the panel elements 1 and 2 are turned, then the situation shown in FIG. 3 results in which the lateral edge surfaces 5, 6 come to lie on top of one another. As can be seen in FIGS. 1 to 3, the lateral edge surfaces 5, 6 have a further profiling 11, 12 toward the profiled bearing and contact surface 7, 8 which enter into a form-locking connection 13 when the lateral edge surfaces 5, 6 are turned on one another, as shown in FIG. 3.

In this case, the profiling 11 of the one connecting edge 5 is conical and the profiling 12 of the other connecting edge 6 is groove-shaped. Preferably, the conical connecting edge 5 is V-shaped and the groove-shaped connecting edge is shaped accordingly so as to correspond thereto, so that a male and a female connection of the edge area of the two panel segments 1 and 2 is produced.

As can be seen in FIGS. 1 and 2, the profiled areas of the bearing and contact surface 7, 8 of the lateral edge surfaces 5, 6 are at a slant 14, 15 (i.e., extend non-perpendicularly from a side surface S1 of the respective panel) which form a triangular space 16 between the lateral edge surfaces 5, 6 when the panel elements 1, 2 are turned. The space 16 is limited by the form-locking connection 13. In this way, a suitable free space 16 for the adhesive strip 9 is produced in the turned state of the panel segments 1, 2, in which the adhesive strip 9 is able to yield unhindered despite the turning or folding. The bearing and contact surface 7, 8 offers a sufficient area on which the adhesive strip 9 connecting the panel elements 1, 2 can be securely and adhesively applied.

Figure 4:
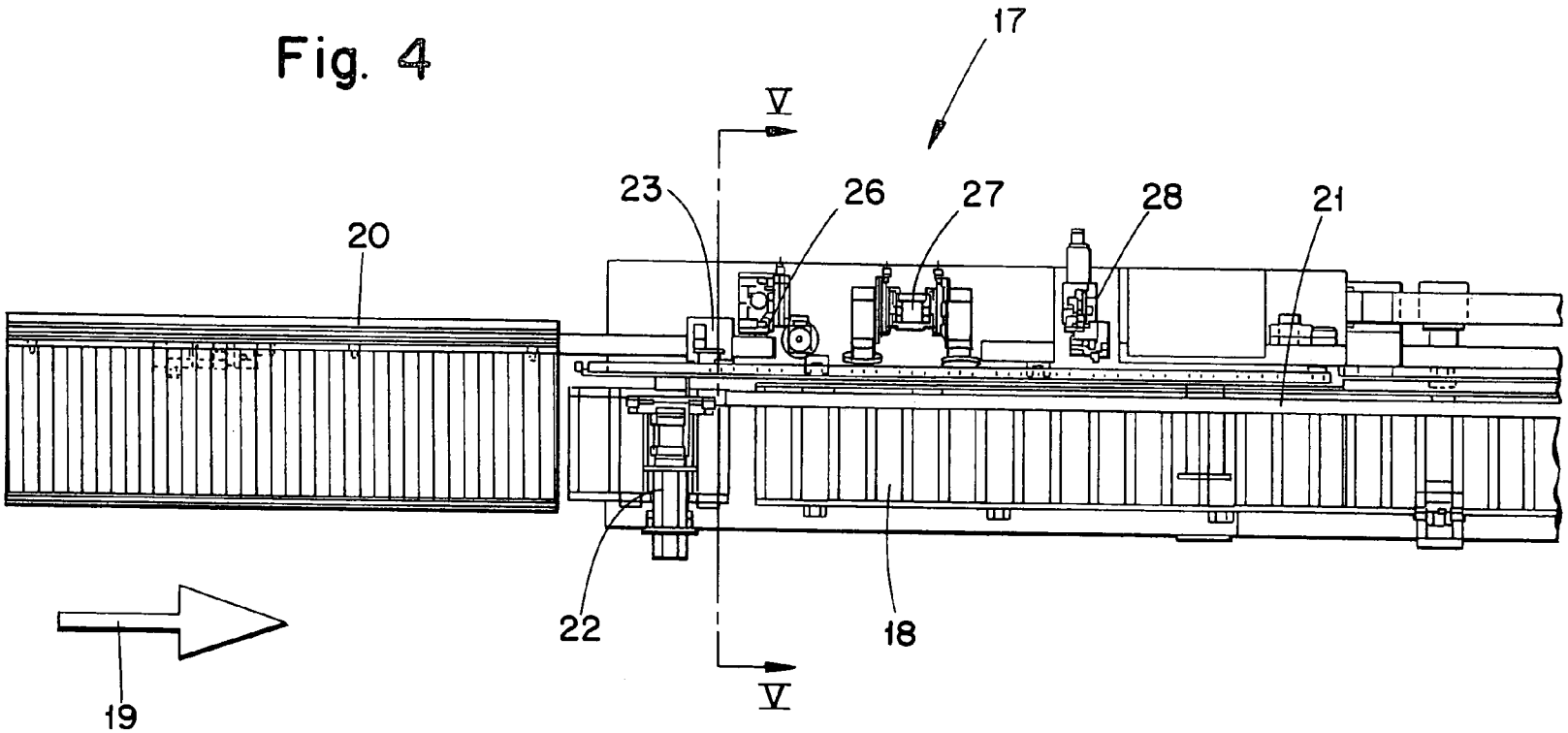
FIG. 4 an assembly line in a partially cut top view for producing foldable panel elements.

In a partial sectional top view, FIG. 4 shows a facility 17 in a partial sectional top view for producing the panel elements 1 and 2 of the invention which are flexibly connected to one another. The facility 17 comprises a conveying device 18, the panel elements 1 and 2 passing through in direction of arrow 19. The panel elements 1 and 2 lying on top of one another are conveyed along a guide arm 21 via a feed table 20. The superimposed panel elements 1 and 2 are first conveyed into an edging unit 22. A measuring apparatus 23 is subsequently connected to the edging unit 22, as shown in a separate view and in a sectional representation in FIG. 5.

The measuring apparatus 23 measures the thickness 24 produced in the facility 17 of the superimposed panel elements 1 and 2 for the numerical determination of a zero-point position 25 which corresponds to the fold edge about which the panel elements 1 and 2 are folded. Due to this ascertained zero-point position 25, the subsequently connected units for processing the connecting edges 5 and 6, shown in a broken line in the separate view, are adjusted to the zero-point position 25 by means of a digital control. In this way, the digital control drives the milling tool 26 for profiling the connecting edges 5 and 6, the chamfer unit 27, as well as the adhesive applicator 28 exactly into position, so that connecting edges 5 and 6 can be produced by means of the facility 17 relative to the calculated zero-point position 25.

Figure 5:
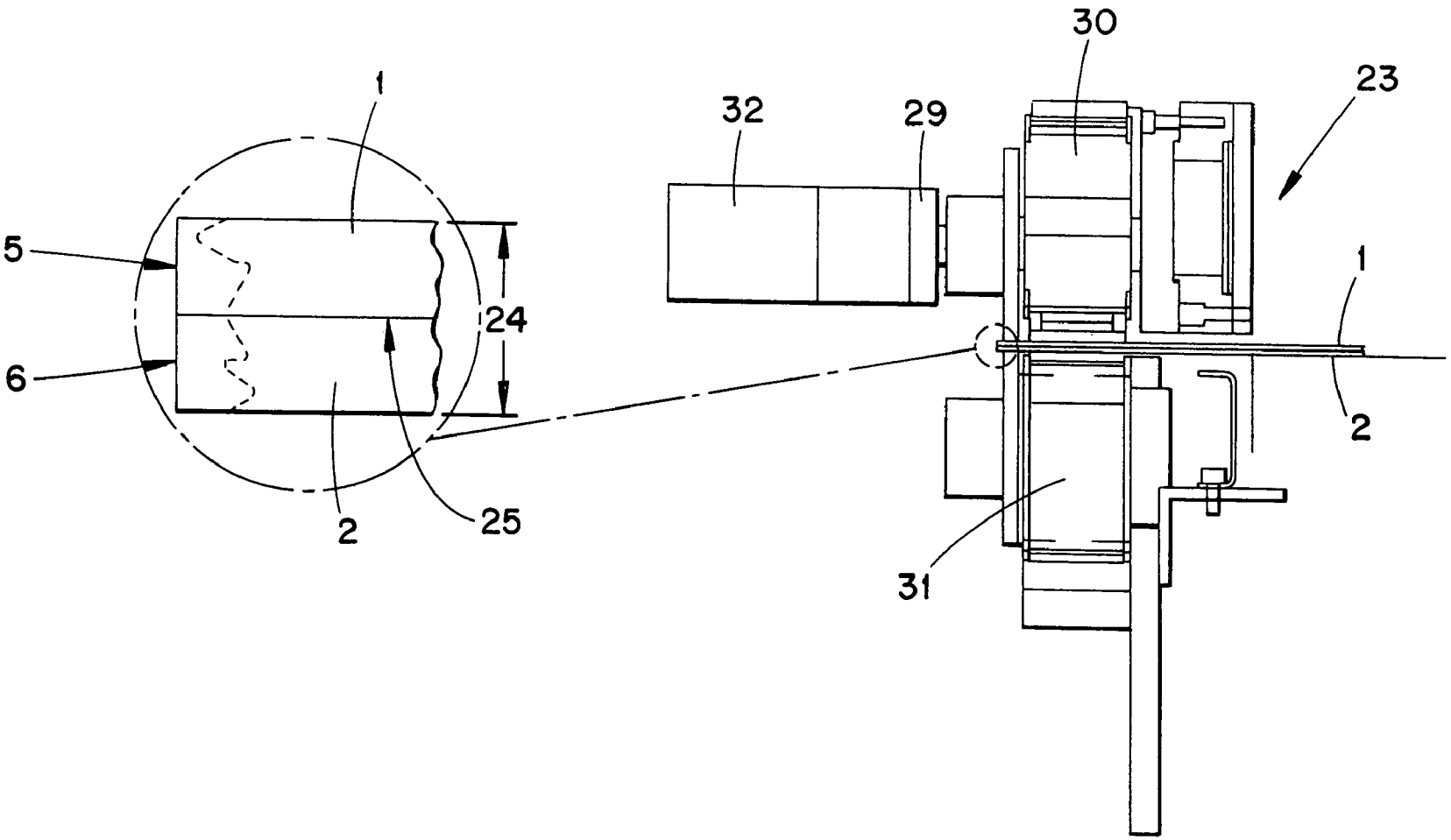
FIG. 5 a sectional side representation along the line V-V in FIG. 4, wherein especially the superimposed panel elements with their fold edge are emphasized in a separate view.

As can be seen in the side view in FIG. 5, the measuring apparatus 23 consists essentially of a measuring rocker 29 with a roller 30 which interacts with a supporting roller 31 between which the superimposed panel elements 1 and 2 are led. The measuring rocker 29 which is connected with a pick-up 32 now calculates the exact thickness 24 of the two panel elements 1 and 2, so that a zero-point position 25 is given by means of a computer control (not shown in greater detail) which is used to control the subsequently connected units 26, 27, 28. In an advantageous embodiment of the invention, it is also provided that, for example, the edging unit 22, which is located in front of the measuring apparatus 23, can also be digitally controlled, so that the zero-point position 25 can already be used during the edging.

In this way, a method is produced for the manufacture of such panel elements 1 and 2 that can be folded which is characterized in that the thickness 24 of the superimposed panel elements 1 and 2 can first be produced in a first procedural step in order to obtain a zero-point position determination of the fold edge in this way and, in a second procedural step, the units 26, 27, 28 required for processing the connecting edges 5 and 6 are adjusted accordingly to the zero-point position 25 by means of a digital computer control.

What is claimed is:

1. Two panel elements which are flexibly connected to one another by an adhesive strip to create a swivel axis about which the panel elements are relatively turnable, each panel element including a profiled lateral edge surface arranged so that the panel elements are relatively turnable to a position in which the respective profiled lateral edge surfaces face each other, each profiled lateral edge surface including a bearing surface portion to which a respective part of the adhesive strip is connected, wherein the profiled lateral edge surface of one panel element further includes a projection, and the profiled lateral edge surface of the other panel element further includes a groove arranged to receive the projection when the panel elements are turned to said position in which the profiled lateral edge surfaces face one another, wherein each panel element includes a pair of side surfaces intersected by the respective profiled lateral edge surface, each bearing surface extending non-perpendicularly from a side surface of its respective panel element, wherein the bearing surfaces of the respective panel elements form a recess therebetween when the panel elements are in said position in which the profiled lateral edge surfaces face each other.

2. Two panel elements according to claim 1, wherein the projection and the groove are generally conical.

3. Two panel elements according to claim 1, wherein the projection and the groove are generally V-shaped in cross section.

* * * * *